United States Patent [19]

Avritt et al.

[11] 4,216,955

[45] Aug. 12, 1980

[54] JAM CLEARANCE MECHANISM FOR A TRAVELING DISTRIBUTOR IN A COLLATING SYSTEM

[75] Inventors: Michael D. Avritt; Richard A. Lamos, both of Boulder; Alfonso A. Rosati, Longmont, all of Colo.

[73] Assignee: International Business Machines Corporation, Armonk, N.Y.

[21] Appl. No.: 25,650

[22] Filed: Mar. 30, 1979

[51] Int. Cl.[2] ..... B65H 29/60

[52] U.S. Cl. ..... 271/296; 198/813; 271/197

[58] Field of Search ..... 271/296, 287, 302, 279, 271/289, 291, 197, 294, 297; 270/58; 198/585, 813, 814, 815, 816

[56] References Cited

U.S. PATENT DOCUMENTS

| | | | |
|---|---|---|---|
| 1,709,549 | 4/1929 | Webber | 198/813 |
| 2,328,317 | 8/1943 | Wentworth | 271/296 X |
| 3,414,254 | 12/1968 | Snellman et al. | 271/296 |
| 3,638,937 | 2/1972 | Schulz et al. | 271/296 X |
| 4,006,894 | 2/1977 | Raible et al. | 271/296 |
| 4,111,410 | 9/1978 | Tates et al. | 271/297 X |
| 4,116,429 | 9/1978 | Van Buskirk et al. | 271/287 |
| 4,124,204 | 11/1978 | Van Buskirk | 271/287 |

OTHER PUBLICATIONS

IBM Copier Service Manual, IBM Series III Copier/-Duplicator, 1976 by IBM Corp. (IBM Form No. 241-5928-0).

*Primary Examiner*—Bruce H. Stoner, Jr.
*Attorney, Agent, or Firm*—Earl C. Hancock

[57] ABSTRACT

Sheets are delivered to receptacles by a traveling distributor which includes an incrementally movable carriage. A continuous loop belt or belts such as in a vacuum plenum transport convey the sheets to the carriage where a roller arrangement on the carriage diverts the belts and thus the sheets into a direction in alignment with the receptacles. The rollers then divert the belt away from the receptacles so that the sheets continue into the receptacles. The rollers are mounted so as to place the belt or belts in tension during normal operation but are movable to relieve the belt tension to facilitate paper removal from the belt in jam clearance procedures.

6 Claims, 8 Drawing Figures

JAM CLEARANCE MECHANISM FOR A TRAVELING DISTRIBUTOR IN A COLLATING SYSTEM

DESCRIPTION

1. Field of the Invention

The present invention relates to apparatus for jam clearance in sheet collators or sorters. More particularly, the present invention relates to mechanisms for facilitating jam clearance in a collator or sorter which employs a traveling distributor to deliver sheets to an array of receptacles by diverting sheet conveying, continuous loop cords or belts towards the receptacles. Although not necessarily limited thereto, the present invention is particularly useful for facilitating jam recovery in a collator which employs a continuous loop belt or belts running over a vacuum plenum with an incrementally movable carriage having rollers for diverting the sheet carrying belt into alignment with the receptacles.

2. Description of the Prior Art

Devices for sorting or collating a serial stream of various documents have been available for many years. For instance, sorters using a pivotable gate at the entrance of each receptacle or bin for diverting documents from a conveyor used extensively to sort or collate cards carrying data and/or printed matter have been known since shortly after the turn of this century. Such multiple gate sorters enjoy the advantages of high speed collating and of adaptability to random sorting. However they do require a relatively large number of moving parts which is less desirable with respect to the design of the machinery and also relative to reliability for long term operation.

A simpler sheet distributing mechanism is shown in U.S. Pat. No. 2,328,317 which issued Aug. 31, 1943 to R. S. Wentworth. Wentworth teaches the use of a single traveling deflector for distributing sheets, cards, or the like to an array of bins in a manner which avoids the problems associated with including a greater number of moving parts as in the multiple gate prior art mentioned above. The Wentworth apparatus utilizes a set of continuous loop facing cords or belts to convey documents to a movable carriage where the cords on the side towards an array of receptacle openings are diverted away from the plane of the receptacle openings whereas the oppositely facing cords are diverted by rollers initially in a direction towards the receptacle openings and thence in a direction away from those openings. Thus, documents carried by the facing cords in Wentworth to the carriage are propelled into a plane aligned with the receptacles and directed into the receptacles at the point where the aforementioned oppositely facing cord or cords are rediverted away from the receptacle openings. Wentworth's apparatus includes a sensor switch for detecting the delivery of each sheet to a receptacle and a control responsive to actuation of the detector switch for incrementally moving the carriage between the receptacles during the course of a collation run. The carriage is automatically returned to the start position at the end of each run.

Vacuum belt document transports have been well known for many years and can be used in place of facing belts or cords as shown by Wentworth in devices of the type wherein sheets are delivered to bins by diversion of belts or cords. That is, the flexible belt or belts which typically run around a vacuum plenum in vacuum belt transports can be diverted to deliver sheets to receptable openings using a roller assembly on a carriage in place of facing cord or belt arrangements. The vacuum belt beyond the point at which the sheets are released into the receptacles can be either returned directly to the end of the receptacles as is specifically shown for the cord in Wentworth or rediverted back to the surface of the vacuum plenum. Various prior art techniques for air flow control in the portion of the vacuum plenum downstream from the carriage are available. Thus, whether the vacuum belt is returned directly to the end of the receptacle tier as in Wentworth or to the surface of the vacuum plenum is a matter of design choice. The use of vacuum transport belts rather than facing cords as in Wentworth forms no part of this invention.

In collators of the type wherein belts or cords are diverted for sheet delivery to bins, these belts or cords of the document conveyor are normally under tension. Unfortunately this tension creates a problem in the event that the machine becomes jammed and sheets must be removed from between the belts or cords and the rollers. One arrangement for releasing belt tension to allow sheet removal in a multiple gate collator is shown in U.S. Pat. Nos. 4,111,410, 4,116,429, and 4,124,204 wherein the entire belt conveyor section is pivotable away from the bin openings. As shown particularly in FIG. 13 of 4,124,204, a roller 60 attached to the main machine frame is positioned such that it presses against the belts to place them in tension when the conveyor section is closed but releases the belt tension when the conveyor section is pivoted open.

There is no known prior art device for relieving belt or cord tension in a conveyor system wherein the belts or cords are diverted for sheet distribution purposes at a movable carriage. Further, there is no known prior art device for relieving belt or cord tension directly at the diversion rollers of the aforementioned carriage to facilitate removal of sheets from between the rollers and the belt or cords.

SUMMARY OF THE INVENTION

The present invention is an apparatus for facilitating jam recovery by belt or cord tension relief in a collator or sorter using a belt or cord diverting traveling distributor. Such collators distribute sheets into a plurality of receptacles or bins which have openings along a common plane. The sheet conveyor includes at least one flexible belt or cord arranged in a continuous loop. A traveling distributor on a carriage is movable incrementally in parallel relation to the common plane of the receptacle openings. This carriage includes at least first and second roller assemblies. The first roller assembly diverts the belt from a plane spaced from, but parallel to the receptacle opening common plane to a direction towards the common plane and the second roller assembly is arranged for further diverting the belt at least into a plane parallel to the common plane. Thus, sheets conveyed by the belt are directed into the receptacles through the openings thereof by means of the inherent stiffness and momentum of the documents as the belt is diverted by the second roller. Means are included for continuously moving the belt and also for selectively moving the carriage.

The present invention is an improvement in the aforementioned type of collator arrangement. The invention includes a mounting means on the distributor carriage securing one of its rollers in its sheet distributing position for applying tension to the belt. The mounting means has a selectively operable means for moving the aforementioned one of the rollers in a direction for relieving the belt tension thereby permitting removal of sheets from between the belt and the first roller. Accordingly, the removal of sheets from the belt as for jam recovery purposes is facilitated by operation of the selectively operable belt tension releasing means.

The belt tension applying/relieving structure of this invention is preferably associated with the second belt diverting roller since this minimizes belt to roller sheet gripping while allowing the greatest degree of access of the user during jam recovery. Thus the invention can be in the form of a latch for securing the second roller in its normal operating position with the selectively operable means including means for releasing this latch to allow the second roller to move in a direction away from the receptacle opening common plane. Operation of the invention can be augmented by including biasing means applying a force between the second roller and the latch in a direction towards the roller securing position therebetween.

As will be described below in the detailed description, the roller assembly mounting preferably employs a latch arm pivotally mounted at one end with a recess in the other end for receiving the movable roller assembly. The latch arm can be pivoted so that its recess is moved into and out of roller assembly engagement by a user accessible lever.

The foregoing and other objects, features, advantages, and applications of the present invention will be readily apparent to those having normal skill in the art from the following more detailed description of the exemplary preferred embodiments as illustrated in the accompanying drawings.

DETAILED DESCRIPTION OF THE PREFERRED EMBODIMENT

Figure 1:
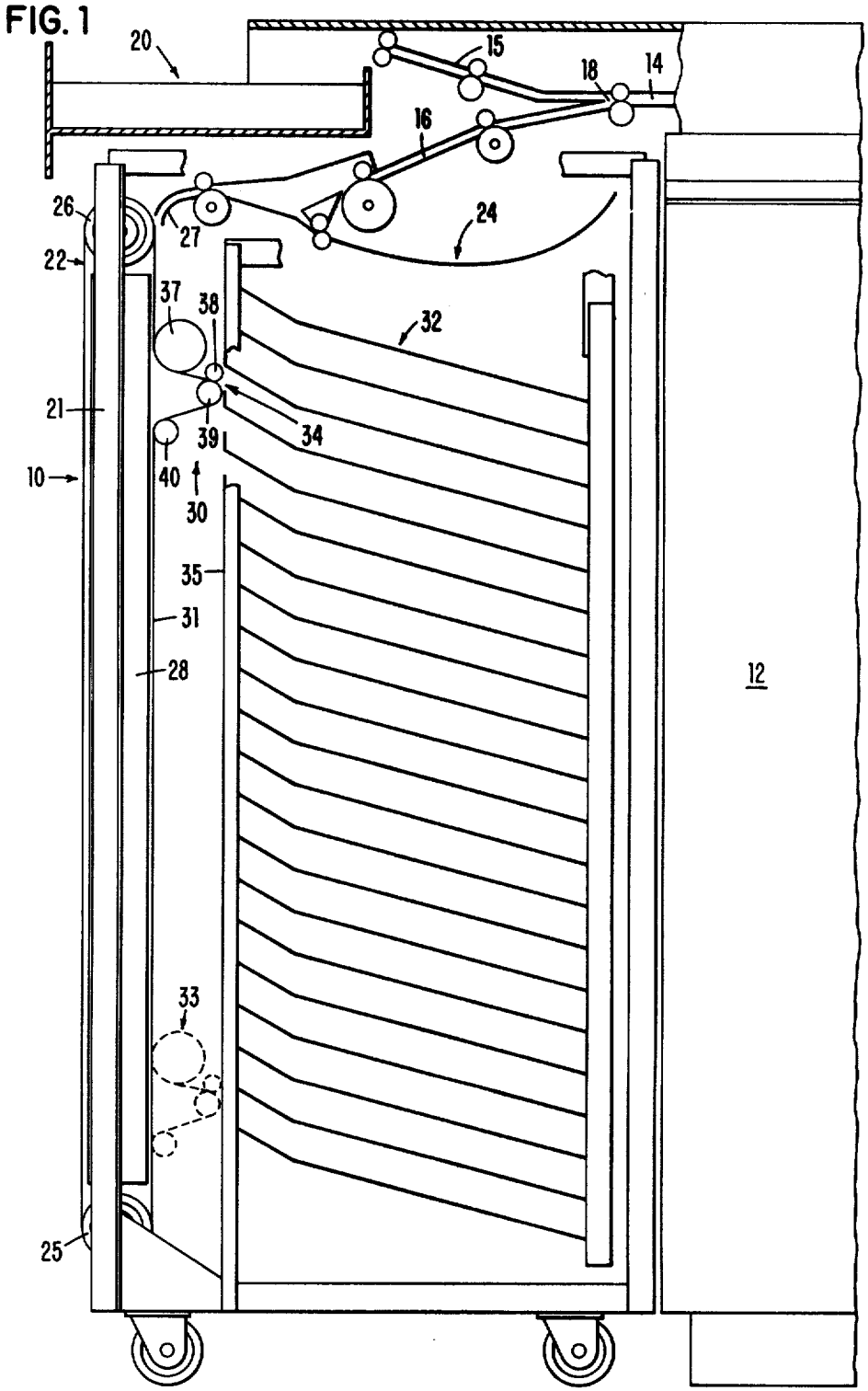
FIG. 1 is a partially broken and sectioned side view of a collator including a traveling distributor in which the present invention can be implemented.

In FIG. 1, collator/sorter 10 is shown attached to a source of a stream of documents, cards, sheets, or the like with the particular source being illustrated here as an office copier 12. The document stream output 14 is fed to collator 10 which includes conventional path defining guides 15 and 16 with a selectively operable gate at junction 18 to direct the sheets into one of paths 15 and 16. Path 15 terminates at tray 20 whereas sheets from path 16 are passed to vacuum belt conveyor system 22 either directly or after being turned in inverter 24.

A pair of flexible belts 31 are arranged in a continuous loop around elongated vacuum plenum 28. Belts 31 are continuously driven by means not shown and a vacuum is drawn on the inner chamber of plenum 28 also by means not shown. Thus as sheets exit from output guide 27, they are drawn to the surface of belts 31 and held there due to the air pressure differential. These sheets are conveyed to distributor 30 where they turn with the belts toward the openings of receptacles or bins 32 by means of idler roller assemblies 37, 38, and 39. Bins 32 are arranged with the openings thereof such as opening 34 in a common plane indicated at 35. As the belts are diverted away from common plane 35 around idler roller assembly 39, the sheet or sheets conveyed thereby continue through the receptacle opening 34 due to the inherent stiffness and momentum of the sheet. Idler roller assembly 40 directs the belts back into parallel relation with the surface of vacuum plenum 28. Distributor 30 can be indexed from one bin opening to the next until it reaches the final position shown in dashed lines at 33. Distributor 30 can further be returned to the topmost bin 32 position at the end of any given run whatever its length, and/or can be incremented upward while continuing to distribute sheets to bins 32.

Figure 2:
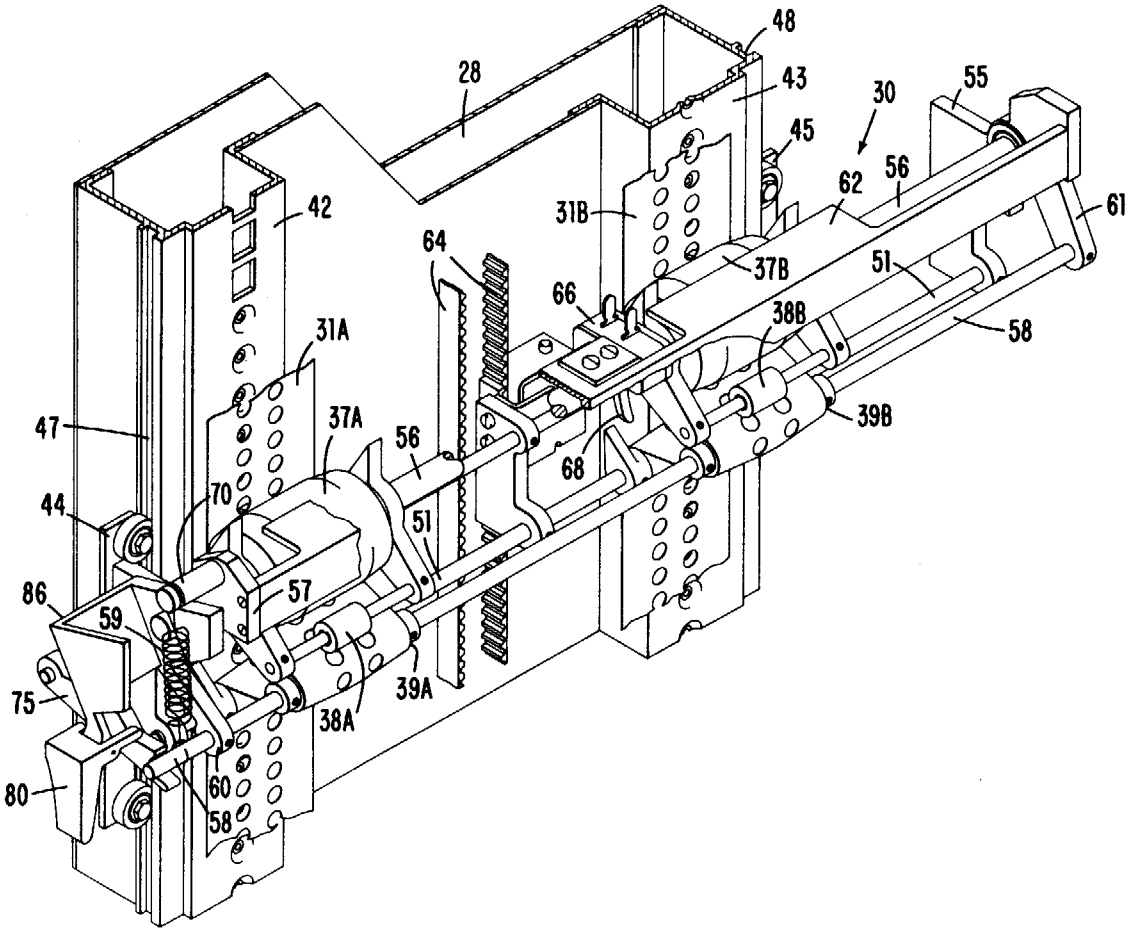
FIG. 2 is an isometric view particularly showing detail of the jam clearance structure of the present invention relative to the traveling distributor carriage.
Figure 3:
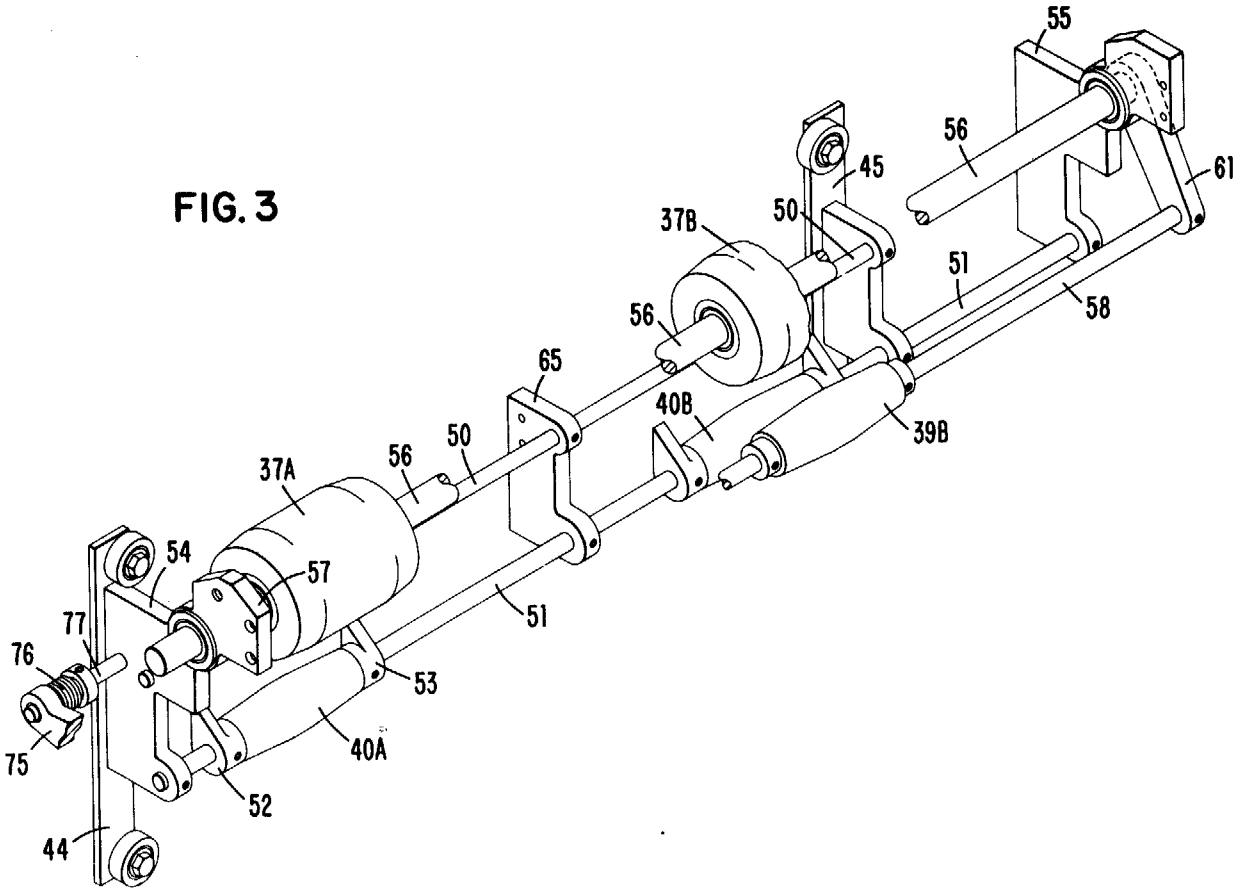
FIG. 3 is an isometric and partially broken view showing the relationship between selected elements of the distributor carriage generally illustrated the mounting arrangement of the rollers to the carriage.

The detail of the distributor 30 is best seen in FIGS. 2 and 3. End plates 44 and 45 have wheels attached thereto to allow tracking within channels 47 and 48, respectively. Plates 44 and 45 are held together by rods 50 and 51. Rod 51 further has rollers 40A and 40B rotatably attached thereon between fixed ears such as 52 and 53 to prevent belts 31A and 31B from being displaced laterally whenever tension is removed from those belts. Transversely extending bracket 54 of end plate 44 is connected to mounting plate 55 by shaft 56 on which idler rollers 37A and 37B are mounted for free rotation. Shaft 58 is pivotably attached to bracket 54 at one end by arm 60 of yoke 86 and to mounting plate 55 at the other end by arm 61. Mounting bracket 54 and end plate 55 are further secured by beam 62, portions of which are L-shaped.

Movement of distributor carriage 30 along plenum 28 is controlled by toothed belt 64 which is clamped to plate 65. Plate 65 is also fixed to rods 50 and 51. Belt 64 is a continuous loop passing around sprockets (not shown) at the top and bottom of plenum 28. As sheets pass outwardly from the plenum surface toward the receptacle openings, they actuate pivotable arm 68 of switch 66 attached to beam 62 to generate signals for control apparatus (not shown) which in turn moves belt 64 and thus distributor 30.

Outer portion 57 of bracket 54 has a stub 70 attached thereto. A spring 59 is attached between stub 70 and shaft 58 as is best seen in FIG. 2. Spring 59 normally applies a biasing force to shaft 58 in a direction tending to pivot shaft 58 so as to oppose the force associated with the tension in belts 31A and 31B. That is, with the structure in the normal sheet distributing position as shown in FIG. 2, belts 31A and 31B are under tension and thus apply forces to idler roller assemblies 39 tending to rotate them toward plenum 28 through the agency of shaft 58 and rotatably mounted arms 60 and 61. The bias force from spring 59 on stub 70 counteracts the belt tension force and facilitates release and reapplication of belt tension in accordance with the jam clearance structure described below. It is this normal tension in belts 31 that can trap sheets as between belt 31A and rollers 37A or 38A and belt 31B and rollers 37B or 38B, thereby preventing such sheets from being removed for jam clearance.

It should be noted that the belts 31 and surfaces 42 and 43 of plenum 28 which contain vacuum ports for cooperating with belts 31 are shown in this illustrative preferred embodiment as they might be located for handling sheets fed with their long dimension horizontal. For example, the long dimension of a 8½×11 inch sheet might just cover the horizontal width of plenum 28. However, the carriage 30 is extended as by the distance between plates 45 and 55 to accomodate the long dimension of longer sheets. This extension area is indicated as 46 in FIG. 6. Positive control of the portion of longer sheets extending beyond plenum 28 into area 46 can be provided by any of several alternatives. For instance, extra sets of idler roller assemblies like 37, 38, and/or 39 can be included in area 46 with or without yet another belt somewhat similar to 31A or 31B either with or without another ported surface of vacuum plenum 28. Alternatively, a passive chute formed by parallel plates can be positioned in area 46 for preventing the ends of long sheets from flapping as they are directed into bins 32. Further, a combination of a passive plate and an additional idler roller assembly can be used (e.g.: a passive upper plate and an additional roller 39, a passive lower plate and additional roller 37, etc.).

The operation of the jam clearance facilitating mechanism in accordance with the present invention is best explained with reference to FIGS. 2, 3, 4, and 5. Latch arm 75 is normally biased upwardly by coil spring 76 attached to shaft 77 on bracket 54 as shown in FIG. 3. That is, spring 76 urges latch arm 75 in a direction tending to cause shaft 58 to seat in recess 78 as shown in FIG. 2. When shaft 58 is seated in recess 78, the tension of belts 31 forces shaft 58 toward plenum 28 thereby ensuring that shaft 58 will remain seated in recess 78.

Figure 4:
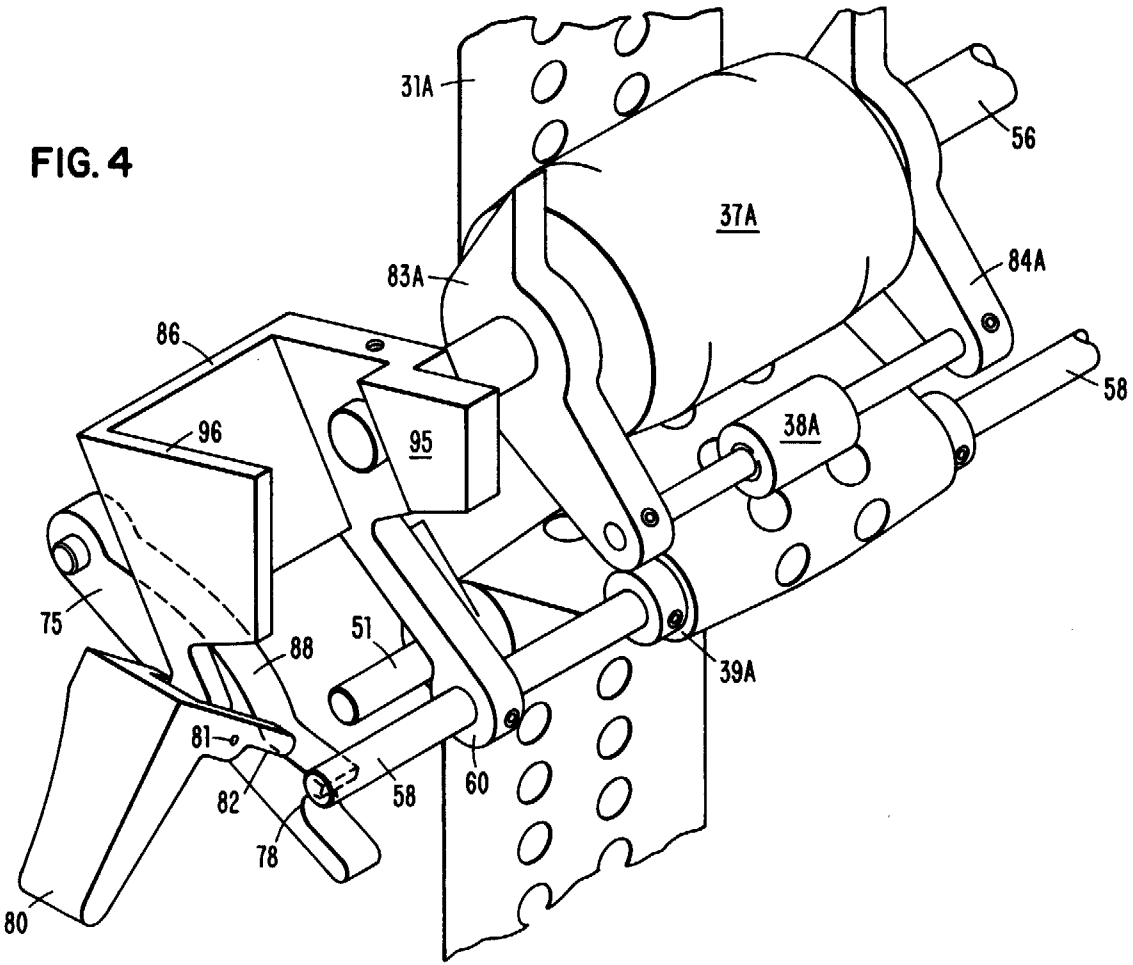
FIG. 4 is an expanded, isometric view of the jam clearance mechanism in its initial belt roller release position.
Figure 5:
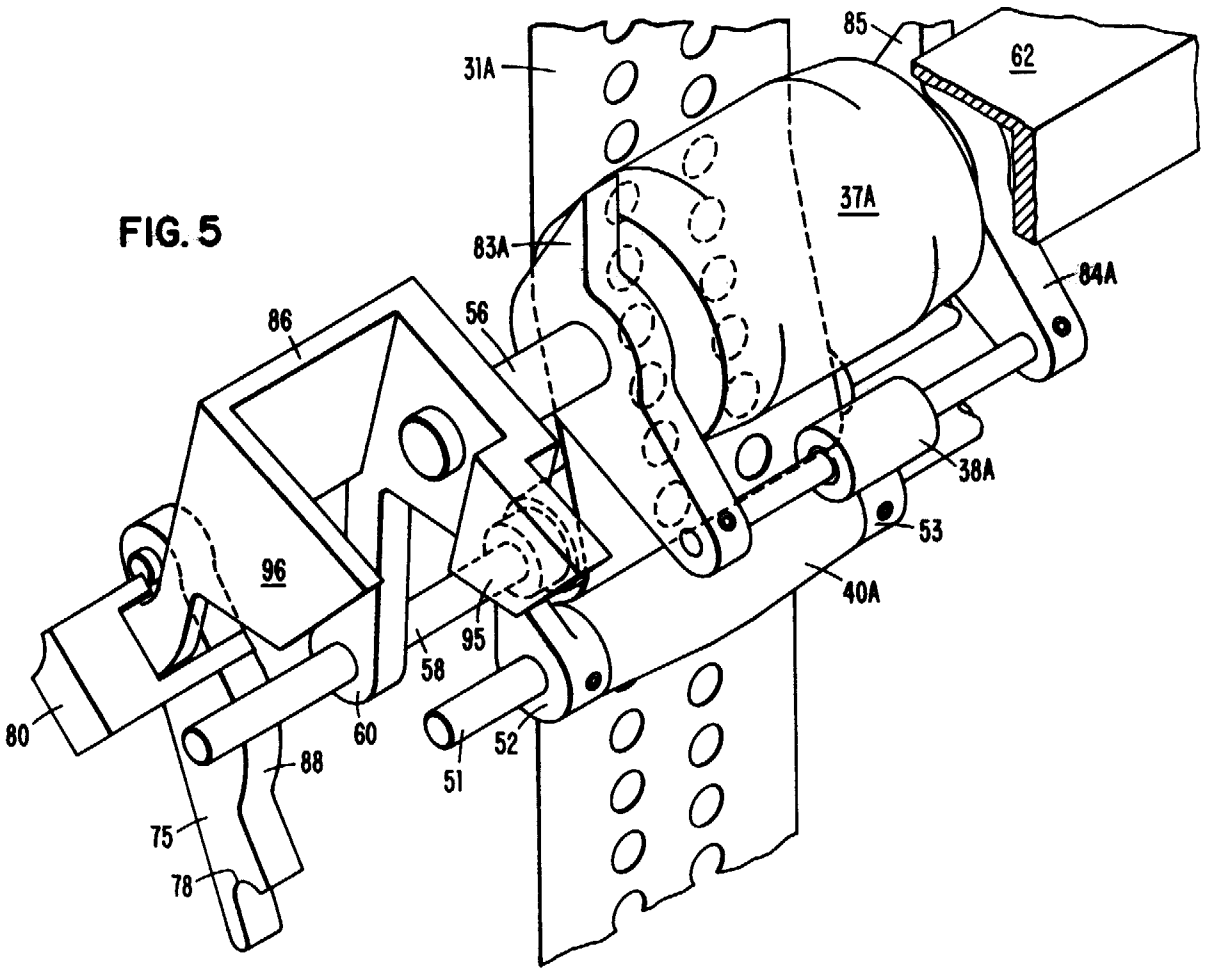
FIG. 5 is another expanded, isometric view of the jam clearance mechanism in its final belt roller release position.

Belt 31 tension relief for jam clearance is initiated by pulling upwardly on lever 80 so that it pivots around pin 81 to depress finger 82 downwardly on latch arm 75. This causes latch arm 75 to release shaft 58 from recess 78 as seen in FIG. 4. The tension on belts 31 then causes shaft 58 to pivot around shaft 56 via pivot arms 60 and 61 and to push downwardly on arm 75 until shaft 58 reaches a position as shown in FIG. 5. At this point, tension in belts 31 has been substantially relieved so that paper can be removed from any location on belts 31 as needed. Paper removal is further facilitated by the reduced area of wrap of belts 31 around rollers 37 when the device is in the tension relief position of FIG. 5. Although the tension in belts 31 could be completely released if desired, it has been found that retention of some residual tension in belts 31 not only does not inhibit sheet removal, but has the salutary affect of preventing lateral displacement of belts 31 when sheets are slid from between belts 31 and rollers 37.

Note that idler rollers 38 are pivotally mounted to shaft 56 by side arms 83 and 84 which are spring biased downwardly by means not shown to ensure that idler rollers 38 engage belts 31 in normal operation. Side arms 83 and 84 each have extension ears such as 85 shown in FIG. 5 which abut L-beam 62 when tension is reduced from belts 31 so that idler rollers 38 will then be displaced from belts 31. Accordingly, rollers 38 are clear of belts 31 and belts 31 are in only loose engagement with the peripheral surface of rollers 37 when the tension relief structure is as depicted in FIG. 5 thereby allowing any sheets to be easily removed from between any of these rollers and the belts.

To reapply tension to belts 31, lever 80 is pivoted to the right around shaft 56 as viewed from the left side in FIG. 5. Since pivot arm 60 is an extension of yoke 86 to which lever 80 is attached, shaft 58 is likewise pivoted outwardly with the assistance of spring 59 attached to stub 70 (note FIG. 2). The bias force from spring 76 urges cam surface 88 against shaft 58 which further augments pivoting of shaft 58 for applying tension to belts 31. The pivotal movement of the structure continues through an intermediate position similar to FIG. 4 until the latched position of FIG. 2 is assumed. The device is then once again ready for normal sheet distributing operation.

Figure 6:
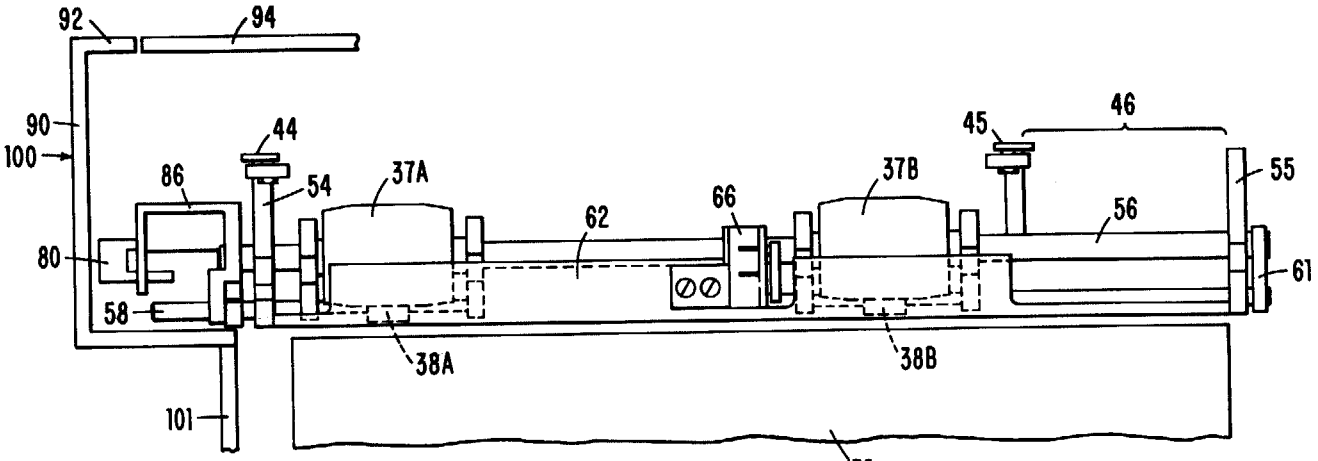
FIG. 6 is a top, partially broken plan view of the FIG. 1 collator.
Figure 7:
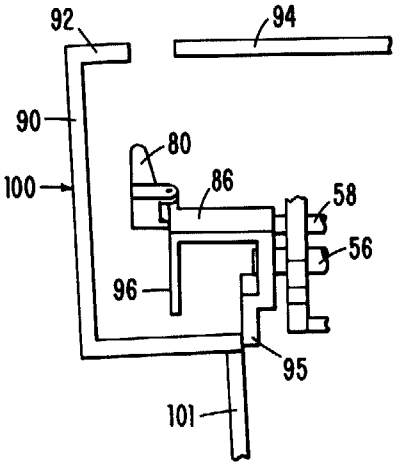
FIG. 7 is a broken view of a portion of FIG. 6 illustrating the door interposer relationship.

FIG. 6 is a broken top plan view of the structure when belt 31 tension is being applied whereas FIG. 7 is a top view showing the position of the yoke 86 assembly when in the belt tension relieving position. These drawings also show the relationship of hinged door 90 to the elements within the device. Door 90 in its fully closed position is shown in FIG. 6 wherein it will be noted that end 92 thereof is in proximity to end cover 94. However, with yoke assembly 86 pivoted for belt tension relief, yoke extension 95 pivots into the position of FIGS. 5 and 7 and is interposed so that door 90 cannot be closed. Typically interlock switches are associated with devices such as here described with such switches requiring door 90 to be fully closed per FIG. 6 to close the switch and enable the machine to operate. By inclusion of extension 95 on yoke 86, door 90 cannot be closed when belt tension has been reduced which is a condition that would cause sheet jams if the machine were to be operated. Extension 96 of yoke 86 could likewise be configured to provide the same interposing function as extension 95, but is primarily included in the structure shown to protect spring 59 between stub 70 and shaft 58 when sheets are being removed during jam clearance. Door 90 is shown in partial sectioned view in FIG. 8 and includes a left side panel 100, an upper panel 101, and a lower panel 102, all interconnected and attached to hinge points 105 and 106 by arms 103 and 104, respectively. Panel 107 is a fixed front cover panel not attached to door 90. Thus door 90 and panel 107 frame an opening through which the user can remove documents from bins 32 without opening door 90.

Figure 8:
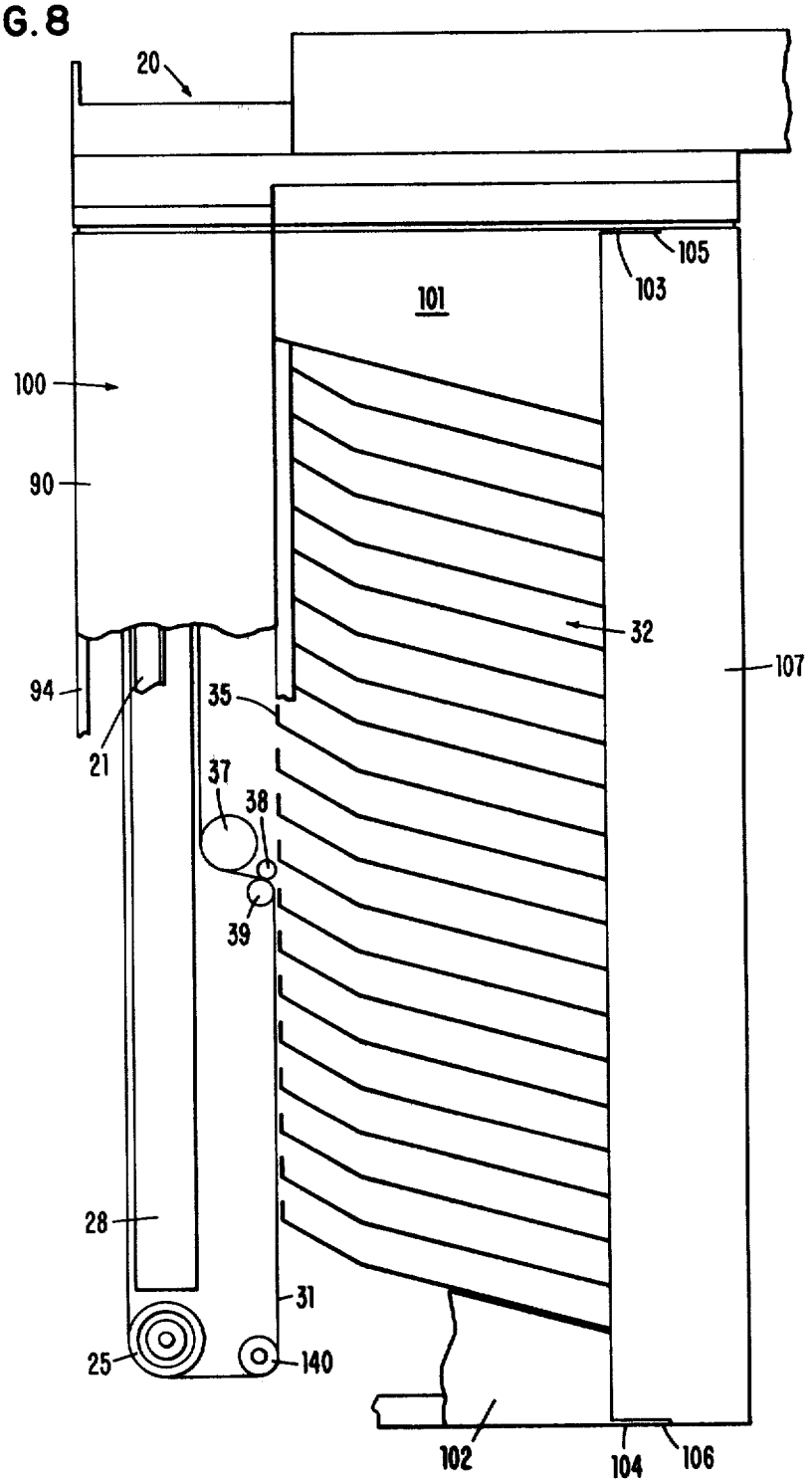
FIG. 8 is a partially broken front view of a collator showing typical enclosure panel relationships and a minor variation of the transport belt configuration of FIG. 1.

FIG. 8 also illustrates another potential return configuration for belts 31. More particularly, after belts 31 have initially been diverted away from plenum 28 and subsequently away from plane 35 by idler roller assemblies 37, 38, and 39, they are initially returned parallel to plane 35 to idler roller assembly 140 and thence around the other side of plenum 28. Note that the belt 31 tension applying/relieving structure of the present invention as described above is fully applicable to a collator with a conveyor belt path as shown in FIG. 8 as it is to that shown in the example of FIG. 1.

Although the present invention has been described with particularly relative to the foregoing detailed description of the exemplary preferred embodiment, various modifications, changes, additions and applications of the present invention, in addition to those mentioned herein, will be readily apparent to those having normal skill in the art without departing from the spirit of this invention.

What is claimed is:

1. In an apparatus for distributing sheets or the like into a plurality of receptacles which have openings along a common plane wherein said apparatus includes a sheet conveyor having at least one flexible belt arranged in a continuous loop, a traveling distributor on a carriage which is movable incrementally in parallel relation to the common plane of the receptacle openings with the carriage including a first roller assembly for diverting the belt from a plane spaced from but parallel to the receptacle opening common plane into a direction towards the common plane and a second roller assembly arranged for further diverting the belt at least into a plane parallel to the common plane whereby sheets conveyed by the belt are directed into the receptacles through the openings thereof by means of the inherent stiffness and momentum of the sheets as the belt is diverted by the second roller assembly, said apparatus further including means for continuously moving the belt and means for selectively moving the carriage, an improvement comprising mounting means on the distributor carriage securing one of said roller assemblies in its sheet distributing position for applying tension to the belt, said mounting means including means selectively operable for moving said one of said roller assemblies in a direction for relieving the tension of the belt thereby permitting removal of sheets from between the belt and said first roller assembly, whereby the removal of sheets from the belt for jam recovery purposes is facilitated by operation of said selectively operable belt tension relieving means.

2. A sheet distributing apparatus improvement in accordance with claim 1 wherein said mounting means includes a latch for securing said second roller assembly in its belt tensioning and sheet distributing position, said selectively operable means of said mounting means including means operable for releasing said latch to allow said second roller assembly to move in a direction away from said receptacle opening common plane.

3. A sheet distributing apparatus improvement in accordance with claim 2 wherein said mounting means includes biasing means applying a force between said second roller assembly and said latch in a direction toward the roller assembly securing position.

4. In an apparatus for distributing sheets or the like into a plurality of receptacles which have openings along a common plane wherein said apparatus includes a vacuum plenum with an elongated surface on which an array of vacuum ports are located with said elongated plenum surface positioned facing said receptacle opening common plane in spaced but parallel relation thereto and with a continuous loop flexible belt driven around said vacuum plenum, a traveling distributor on a carriage which is movable between said plenum surface and the common plane of said receptacle openings including a first roller assembly for diverting the belt from said plenum surface in a direction towards said common plane and a second roller assembly arranged for further diverting the belt at least into a plane parallel to said common plane whereby sheets conveyed by said belt are directed into the receptacles through the openings thereof due to the inherent stiffness and momentum of the sheets as the belt is diverted by a roller of said second roller assembly, said apparatus further including means for causing the belt to move for conveying sheets to said distributor and means for selectively and incrementally moving said distributor carriage, an improvement comprising means mounting said second roller assembly including a latch arm for forcing a roller of said second roller assembly against the belt thereby applying tension to the belt, and means selectively operable for releasing said latch arm from said second roller assembly to reduce tension from the belt whereby jam recovery by removal of sheets from said belt is facilitated by operating said selectively operable means.

5. A sheet distributing apparatus improvement in accordance with claim 4 wherein said latch arm includes a recess for receiving said second roller assembly in one end and means pivotally attaching said arm to the carriage at the other end, said selectively operable means including a lever for pivoting said latch arm between positions of engagement and disengagement of said second roller assembly by said latch arm recess.

6. A sheet distributing apparatus improvement in accordance with claim 5 which includes means applying a biasing force between said latch arm and said second roller assembly for urging said second roller assembly into said latch arm recess.

* * * * *